United States Patent [19]

Allenspach

[11] 4,030,335

[45] June 21, 1977

[54] MULTI-FUNCTION METAL-WORKING MACHINE

[76] Inventor: Walter Allenspach, Bachtobelstrasse 66, Ottoberg (Thurgau), Switzerland

[22] Filed: Mar. 13, 1975

[21] Appl. No.: 558,118

[52] U.S. Cl. ..... 72/389; 72/170

[51] Int. Cl.[2] ..... B21D 7/06

[58] Field of Search ..... 72/389, 386, 385, 170, 72/171, 453

[56] References Cited

UNITED STATES PATENTS

| | | | |
|---|---|---|---|
| 469,763 | 3/1892 | Williams | 72/170 |
| 1,666,909 | 4/1928 | Philippi | 72/171 |
| 1,697,896 | 1/1929 | Yates | 72/170 |
| 2,145,081 | 1/1939 | Gogan | 72/170 |
| 2,650,637 | 9/1953 | Paxson | 72/389 |
| 2,931,417 | 4/1960 | Yurka | 72/171 |
| 3,142,174 | 7/1964 | Baker | 72/389 |
| 3,429,157 | 2/1969 | Huth | 72/389 |
| 3,724,256 | 4/1973 | Kroetch | 72/389 |

FOREIGN PATENTS OR APPLICATIONS

| | | | |
|---|---|---|---|
| 641,725 | 5/1962 | Canada | 72/389 |
| 153,897 | 8/1904 | Germany | 72/390 |
| 11,300 | 6/1965 | Japan | 72/389 |

*Primary Examiner*—C.W. Lanham
*Assistant Examiner*—Gene P. Crosby
*Attorney, Agent, or Firm*—Michael J. Striker

[57] ABSTRACT

A support has spaced ends and a longitudinal passage which extends intermediate these ends. A carriage is mounted for movement in and lengthwise of the passage, and a drive is provided for moving the carriage. At least one first tool holder is provided on the carriage, and a mounting arrangement is located at one or both of the ends for mounting additional tool holders.

11 Claims, 9 Drawing Figures

MULTI-FUNCTION METAL-WORKING MACHINE

BACKGROUND OF THE INVENTION

The present invention relates to metal working machines in general, and more particularly to a multifunction meta-working machine.

Heretofore, different types of metal working operations must be carried out on different types of machines. Each of these machines permits only one or two types of metal working operation to be carried out. This is disadvantageous, especially for small metal working shops, because it necessitates a large investment in many different types of metal working machines, and requires maintenance for all of this equipment which, especially in the case of the small shop, is rarely used to capacity.

SUMMARY OF THE INVENTION

Accordingly, it is an object of the present invention to provide a multi-function metal-working machine which avoids the disadvantages of the prior art.

More particularly, it is an object of the present invention to provide such a metal working machine which can be used to carry out a variety of metal working operations, particularly straightening, bending, rolling, pressing and the like.

In pursuance of these objects, and of others which will become apparent hereafter, one feature of the invention resides in a multi-function metal-working machine which, briefly stated, comprises a support having spaced ends and a longitudinal passage extending intermediate said ends. A carriage is mounted for displacement in and lengthwise of the passage. Moving means is provided for moving the carriage. At least one first tool holder is provided on the carriage. A mounting means is located at least one of the ends of the support for mounting at least one second tool holder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 2:
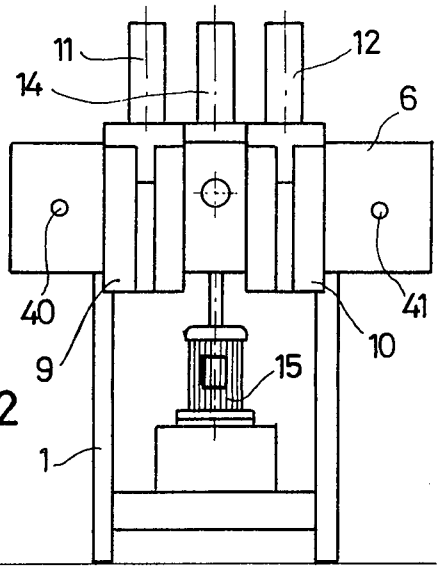
FIG. 2 is an end view of FIG. 1.
Figure 3:
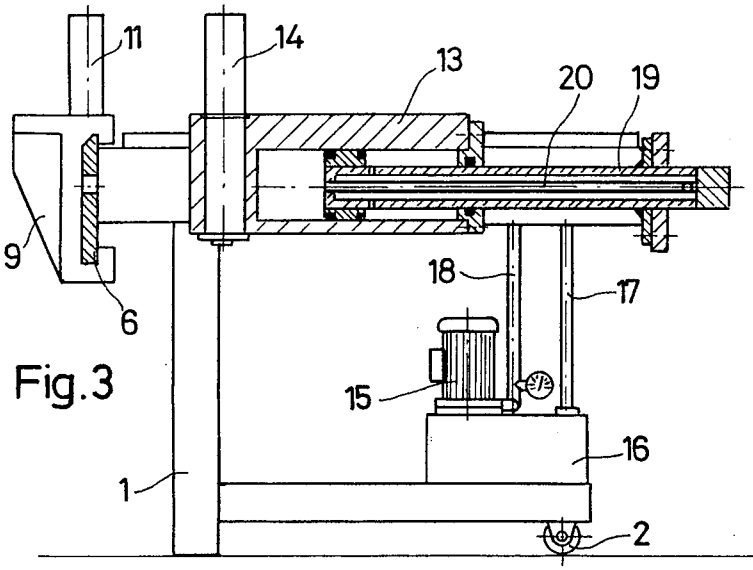
FIG. 3 is a vertical longitudinal section through FIG. 1.
Figure 1:
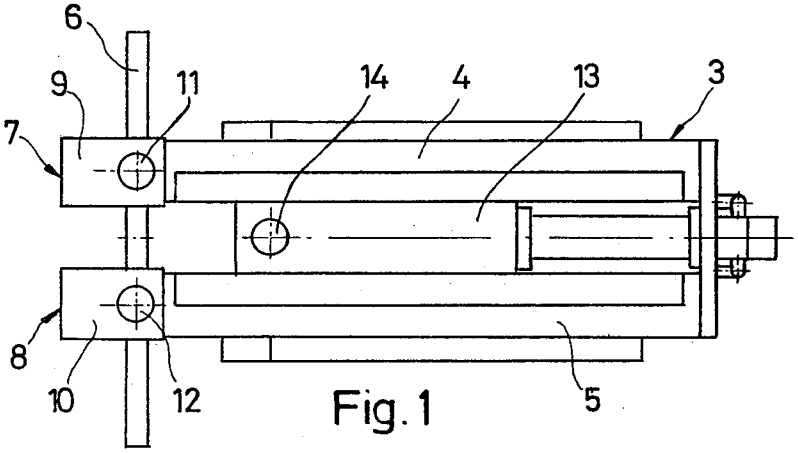
FIG. 1 is a top-plan view of a metal working machine according to the present invention.

DESCRIPTION OF THE PREFERRED EMBODIMENTS:

FIGS. 1–3 illustrate a multi-function metal-working machine of the present invention which has a frame or support 1 one end of which is provided with wheels or rollers 2 in order to make it movable. Reference numeral 3 identifies a further frame having longitudinally extending members 4 and 5 which are connected at opposite axial ends by respective plates 6 and 6'.

The plate 6 extends at lateral sides beyond the members 4 and 5 and is constructed to be able to have tool holders 7 and 8 mounted on it. These tool holders can be pushed on to the plate 6 from the side and can be shifted on the plate. Each of the tool holders 7, 8 has a support 9, 10 with a U-shaped cut-out and in which it can receive an edge portion of the plate 6, and with a stub shaft 11 or 12 on which the respective tool required for a particular operation can be mounted.

A carriage 13 is guided in the longitudinal space between the lateral members 4, 5 and at its end facing towards the plate 6 it is further provided with a stub shaft 14 for mounting of a tool thereon. The carriage 13 can be moved in mutually opposite directions and for this purpose a hydraulic drive is provided which has an oil pump 15, preferably electrically driven, which is mounted on an oil reservoir 16 and is connected via two fluid lines 17, 18 with a double-acting cylinder and piston unit 19 having a piston rod 20 which directly moves the carriage 13. Of course, the showing of a hydraulic drive is only exemplary, and it will be understood that different drives could be employed, for example a pneumatic drive or a mechanical drive having a threaded spindle, which might even be turned manually.

Figure 5:
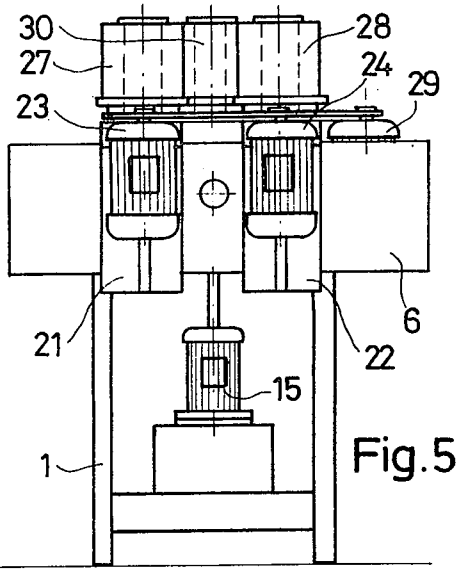
FIG. 5 is an end view of FIG. 4.
Figure 6:
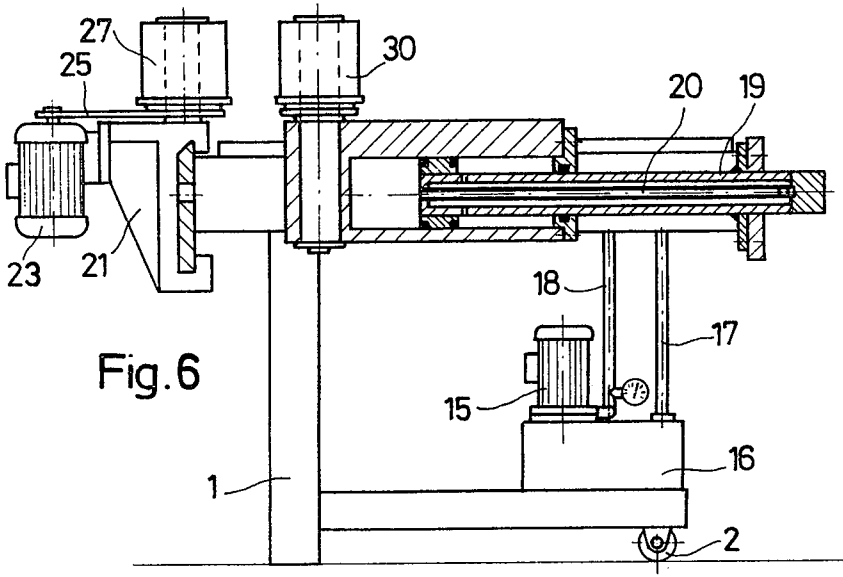
FIG. 6 is a vertical longitudinal section through FIG. 4.
Figure 4:
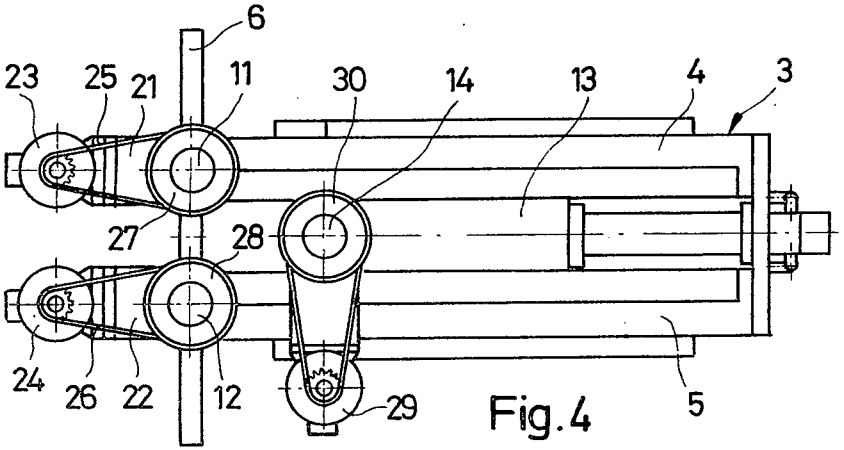
FIG. 4 is a view similar to FIG. 1 illustrating a somewhat different embodiment.

FIGS. 4–6 show a further embodiment of the machine according to the present invention. They are substantially analogous to FIGS. 1–3, and therefore like reference numerals indentify like components. FIGS. 4–6 differ from FIGS. 1–3 in the construction of the two rollers which in this embodiment are provided on their supports 21, 22 with the respective electric motors 23, 24. These motors drive rollers 27, 28 via chains 25, 26. The rollers 27, 28 are turnably mounted on the stub shaft 11, 12.

The carriage 15 in the embodiment of FIGS. 4–6 is also provided with an electric motor 29 which turns a roller 30 which is turnably mounted on the stub shaft 14. It is advantageous if control panels or the like are provided and mounted on the machine for each of said electric motors to make it possible to individually control the several electric motors, or else to operate them synchronously.

Figure 8:
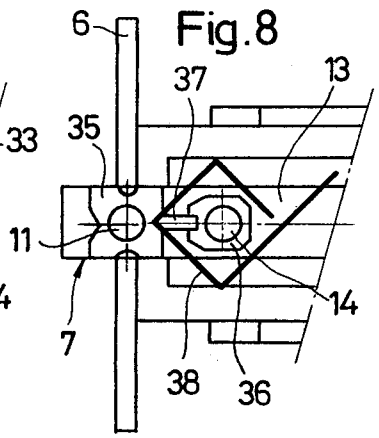
FIG. 8 shows the same machine when it is used for angle-shaping.
Figure 7:
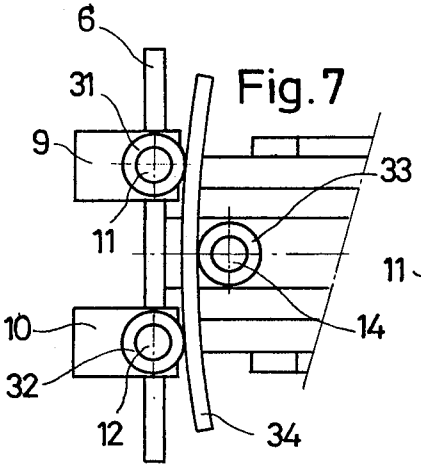
FIG. 7 shows the machine according to the present invention when it is used for bending.
Figure 9:
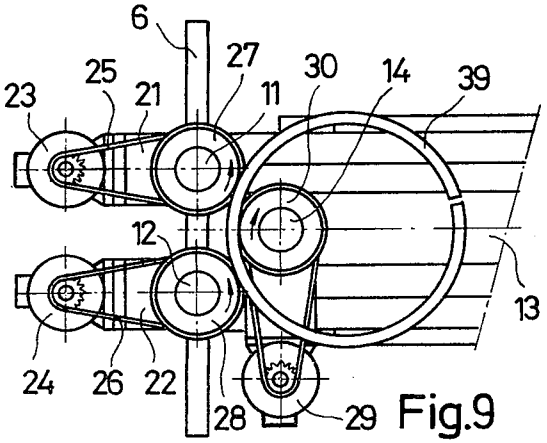
FIG. 9 shows the same machine when it is used for rolling.

FIGS. 7–9 show three different types of metal working operations which can be carried out with the apparatus according to the present invention, for example the one in FIGS. 4–6.

FIG. 7 shows an operation wherein rollers 31, 32 and 33 are mounted on the stub shafts 11, 12 and 14. These rollers are not driven. If a straight workpiece 34 is placed between the rollers, and the roller 33 is moved towards the rollers 31, 32 by shifting of the carriage 13, then the workpiece 34 will be bent in the manner illustrated in FIG. 7.

A different metal working operation is shown in FIG. 8 where only a single workpiece carrier 7 is in use. A member 35 provided with appropriate grooves is mounted on the stub shaft 11 of the carrier 7 by being pushed onto the same. The stub shaft 14 of the carriage 13 carries a wedge 37 which is mounted by means of a holder 36. If a piece of sheet metal or the like, identified with reference numeral 38, is placed between the members 35 and 37, and if thereafter the carriage 13 is moved towards the plate 6, the workpiece 38 is angled, in the illustrated embodiment at a right angle. If a plurality of such angles is formed on one and the same workpiece, then the workpiece 38 can be converted to an annular configuration of quadratic or rectangular outline, or else to a polygonal outline with a selectable number of corners.

FIG. 9 shows how a workpiece 39 can be rolled to a circular ring by using driven rollers 27, 28 and 30. A straight workpiece 39 is placed between the rollers 27, 28 and 30 and thereafter the carriage 13 is moved so that the roller 30 moves close enough to the rollers 27, 28 to effect bending of the workpiece to an extent which corresponds to the curvature of the ring that is to be formed. If hereafter the three rollers 27, 28 and 30 are driven in rotation in the directions indicated by the arrows, by means of the motors 23, 24 and 29, then they will roll the workpiece to the shape of a circular ring.

The embodiment of FIGS. 4–6 and 9 can not only be used for rolling, but also for straightening. It is merely necessary to appropriately select the spacing of the roller 30 from the rollers 27 and 28 in correspondence with the thickness of the workpiece. With the same machine, but without the use of rollers, a pressing operation can also be carried out. In order to be able to press even rather large workpieces the plate 6 is provided with holes 40, 41 by means of which an additional component can be secured to it, for example an additional pressure plate or other member serving as an abutment for the workpiece.

The machine according to the present invention can also be used for stamping, shearing, embossing or the like. The operations can be carried out in the same manner as described before, except that appropriate tools will be used. It is also possible to use this machine for pushing. For this purpose the workpiece is secured to the plate 6, for example by means of an appropriate holding device, and in place of the wedge 37 shown in FIG. 8 an appropriate pushing tool will be mounted on the carriage 13.

The machine according to the present invention is thus a true-multi-function machine which is capable of carrying out a very large number of different metal working operations, merely by exchanging workpiece holders and workpieces. It is also clear that two or more of these machines can be arranged laterally of one another or behind one another, to form a complete sequence of work stations, if desired.

A particular advantage of the machine according to the present invention resides in the fact that the workpieces can be freely inserted both from the side or from above into the machine, and can equally easily removed, and that in no case is it necessary to demount or otherwise remove any part of the machine for this purpose.

It will be understood that each of the elements described above, or two or more together, may also find a useful application in other types of constructions differing from the types described above.

While the invention has been illustrated and described as embodied in a multi-function metal-working machine, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features, that from the stanpoint of prior art, fairly constitute essential characteristics of the generic or specific aspects of this invention.

I claim:

1. A multi-function metal-working machine, comprising a support having spaced ends and a longitudinal passage extending intermediate said ends; a carriage mounted for displacement in and lengthwise of said passage; moving means for moving said carriage; at least one first tool holer on said carriage; mounting means located at least at one of said ends for mounting at least one second tool holder; a plurality of tool holders mountable on said mounting means; tool mounting devices on at least some of said tool holders for detachably mounting tools thereon, said device including projecting stub shafts; and comprising rotating means for rotating said stub shafts and thereby the tools thereon.

2. A multi-function metal-working machine, comprising a support having spaced ends and a longitudinal passage extending intermediate said ends; a carriage mounted for displacement in and lenghtwise of said passage; moving means for moving said carriage; at least one first tool holder on said carriage; and mounting means located at least at one of said ends for mounting at least one second tool holder; a plurality of tool holders mountable on said mounting means; tool mounting devices on at least some of said tool holders for detachably mounting tools thereon; and rotating means for rotating the tools mounted on said devices.

3. A multi-function metal-working machine, comprising a support having spaced ends and a longitudinal passage extending intermediate said ends; a carriage mounted for displacement in and lengthwise of said passage; moving means for moving said carriage; at least one first tool holder on said carriage; and mounting means located at least at one of said ends for mounting at least one second tool holder; a plurality of tool holders mountable on said mounting means; tool mounting devices on at least some of said tool holders for detachably mounting tools thereon; and an electric motor for each of said tool holders to drive a tool mounted thereon.

4. A multi-function metal-working machine, comprising a support having spaced ends and a longitudinal passage extending intermediate said ends; a carriage mounted for displacement in and lengthwise of said passage; moving means for moving said carriage; at least one first tool holder on said carriage; mounting means located at least at one of said ends for mounting at least one second tool holder; additional tool holders mountable on said mounting means; some of said tool holders are provided with a guide groove adapted to slidingly receive a portion of said mounting means; and a plurality of different tools detachably mountable on the respective tool holders, different ones of said tools having different material-treating functions.

5. A machine as defined in claim 4, wherein said guide groove is of dovetail-shaped cross-section.

6. A multi-function metal-working machine comprising a support having spaced ends and a longitudinal passage extending intermediate said ends; a carriage mounted for displacement in and lengthwise of said passage; moving means for moving said carriage; at least one first tool holder on said carriage; mounting means longitudinally extending transverse to said passage at least at one of said ends and projecting laterally beyond said carriage; at least two further tool holders mountable on said mounting means, said further tool holders each being slidable relative to the other along substantially the entire length of said mounting means in a translatory movement in the direction normal to the direction of displacement of said carriage; and a plurality of different tools detachably mounted on the respective tool holders, different ones of said tools adapted to perform different metal-working operations.

7. A machine as defined in claim 6, wherein said moving means comprises a hydraulic drive.

8. A machine as defined in claim 6, wherein at least some of said tool holders are provided with projecting stub shafts.

9. A machine as defined in claim 6; further comprising tool mounting devices on at least some of said tool holders for detachably mounting respective tools thereon.

10. A machine as defined in claim 6, wherein said mounting means comprises a mounting plate.

11. A machine as defined in claim 6; and further comprising wheels on said support.

* * * * *